US007712398B2

(12) United States Patent
Chuang

(10) Patent No.: US 7,712,398 B2
(45) Date of Patent: May 11, 2010

(54) SPRING PLIER

(76) Inventor: Jung-Hua Chuang, No. 3, Lane 6, Sec. 1, Tan Tsu St., Tan Tsu Hsiang, Taichaung Hsien (TW)

( * ) Notice: Subject to any disclaimer, the term of this patent is extended or adjusted under 35 U.S.C. 154(b) by 120 days.

(21) Appl. No.: 12/182,141

(22) Filed: Jul. 30, 2008

(65) Prior Publication Data

US 2010/0024609 A1 Feb. 4, 2010

(51) Int. Cl.
*B25B 7/02* (2006.01)

(52) U.S. Cl. ..... 81/423; 81/485

(58) Field of Classification Search ..... 81/421–424, 81/485, 486, 302, 185.1; 29/229; 30/156, 30/157; 403/61, 91–95, 353–354, 375, 380, 403/116; 269/259–262, 271, 272, 282–284
See application file for complete search history.

(56) References Cited

U.S. PATENT DOCUMENTS 4,499,798 A * 2/1985 Miskiewicz ..... 81/423
6,336,387 B1 * 1/2002 Lee ..... 81/415
6,443,515 B1 * 9/2002 Wu ..... 294/16
6,976,412 B1 * 12/2005 Yu ..... 81/302

* cited by examiner

*Primary Examiner*—D. S Meislin
(74) *Attorney, Agent, or Firm*—Leong C. Lei

(57) ABSTRACT

A spring plier is disclosed. The plier comprises a clipping handle and two symmetrical plier leg plates, and the clipping handle including two reverse direction similar shape plier plates mounted with rivets, the handle mounted with a cover, characterized in that the front end of the two clipping plier plate are respectively provided with a screw hole and a protruded post, the two plier leg plate corresponding to the screw hole and the protruded post are provided with a L-shaped fastening slot and an oval hole, and the front end is a pointed insertion leg, the L-shaped fastening slot engages at a screw fastened to the screw hole at the front end of the plier plate, and the oval hole is placed onto the protruded post, the oval hole provides fine adjustment of leg plate and provides a tolerance facilitating loading and unloading of leg plate, then the screw is tighten so as to secure and limit the two leg plates.

3 Claims, 6 Drawing Sheets

SPRING PLIER

BACKGROUND OF THE INVENTION (a) Technical Field of the Invention

The present invention relates to plier, in particular, a plier which is detachable or replaceable plier legs.

(b) Description of the Prior Art

FIG. 5 shows a conventional plier published in Taiwanese Publication No. 122049. FIG. 6 shows another conventional plier published in Taiwanese Publication No. 223294. In these two pliers, the unloading of the leg is done by using a screw to urge a pressing plate. This way of unloading the leg may cause incomplete urging and the exertion force may cause the leg to loose.

Further, the C-shaped ring is highly elastic and if the operation action is not accurate, the C-shaped ring may be sprang out, which may hurt people. Thus, it is an object of the present invention to provide a spring plier to mitigate the above drawback.

SUMMARY OF THE INVENTION

The primary purpose of the present invention is to provide a spring plier comprising a clipping handle and two symmetrical plier leg plates, and the clipping handle including two reverse direction similar shape plier plates mounted with rivets, the handle mounted with a cover, characterized in that the front end of the two clipping plier plate are respectively provided with a screw hole and a protruded post, the two plier leg plate corresponding to the screw hole and the protruded post are provided with a L-shaped fastening slot and an oval hole, and the front end is a pointed insertion leg, the L-shaped fastening slot engages at a screw fastened to the screw hole at the front end of the plier plate, and the oval hole is placed onto the protruded post, the oval hole provides fine adjustment of leg plate and provides a tolerance facilitating loading and unloading of leg plate, then the screw is tighten so as to secure and limit the two leg plates.

Yet still an object of the present invention is to provide a spring plier, wherein the fastening slot on the leg plate is of opened slot allowing appropriate fastening.

Another object of the present invention is to provide a spring plier, wherein the front end pointed insertion leg of the leg plate is bent to an appropriate angle to provide unloading and loading of C-ring fastener.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
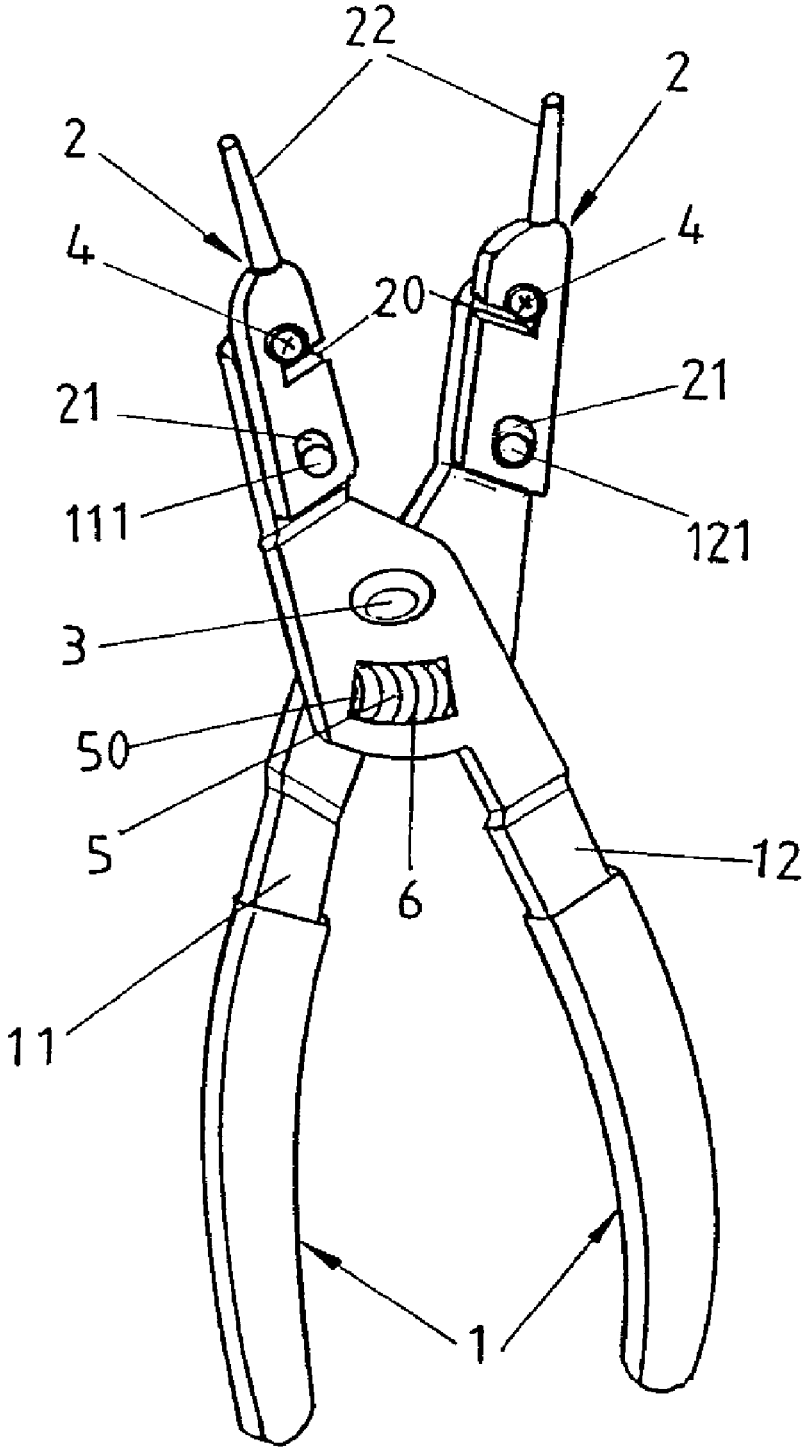
FIG. 1 is a schematic view of a spring plier in accordance with the present invention.
Figure 2:
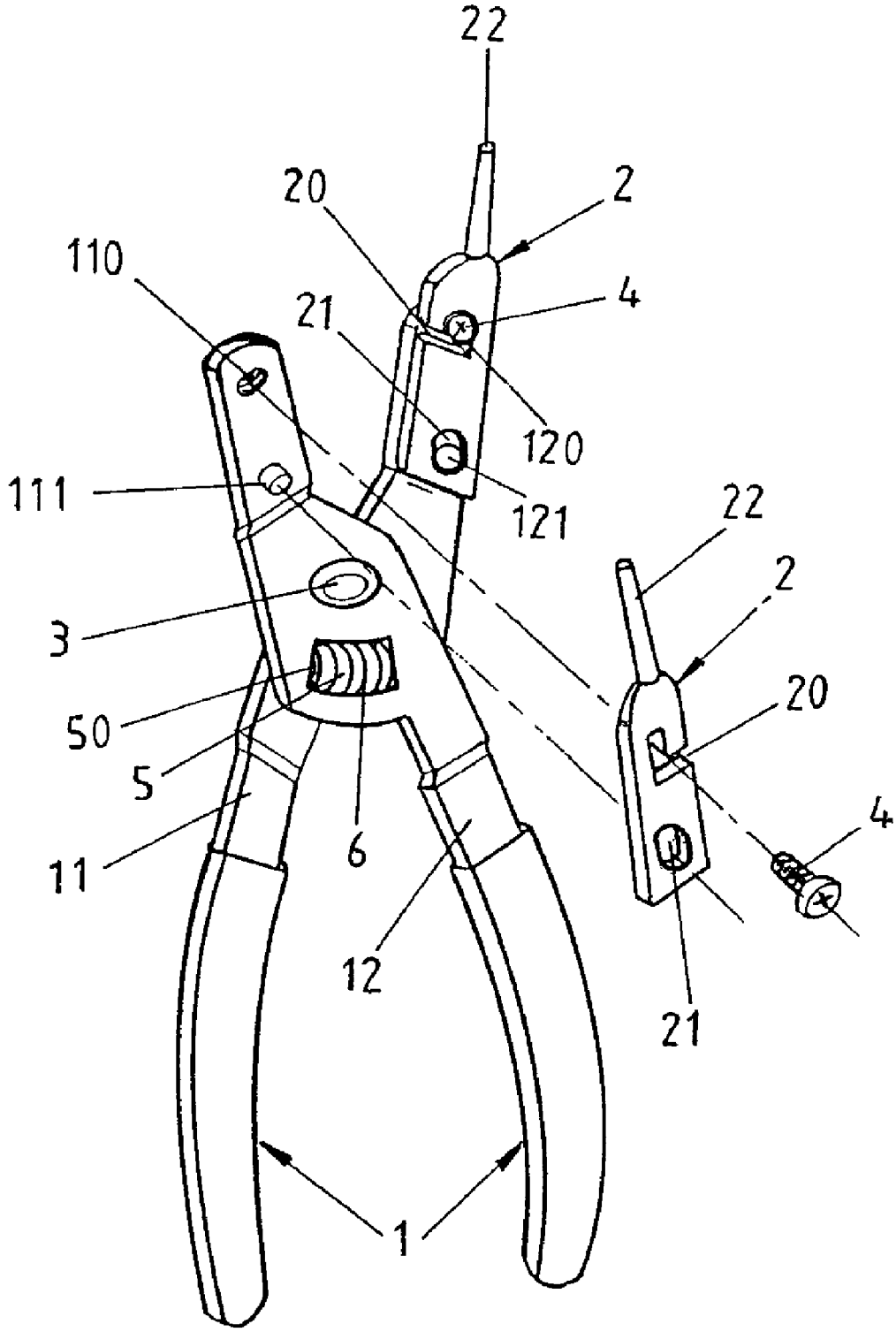
FIG. 2 is an exploded perspective view of a spring plier of the present invention.

Referring to FIGS. 1 and 2, there is shown a perspective view of a spring plier comprising a pair of plier handle 1 and two leg plate 2 mounted at the front end of the handle 1. The handle 1 is formed from two reverse direction similar shape clipping plates 11, 12 riveted with rivet 3. The front ends of the clipping plates 11, 12 are provided with screw holes 110, 120 and a protruded post 111, 121.

On the leg plate 2 corresponding to the screw hole 110, 120 and the protruded post 111, 121 on the front end of the clipping plate 11, 12, an L-shaped slot 20 and an oval hole 21 are formed, and the front end of the leg plate 2 is a pointed leg 22. The L-shaped slot 20 engaged at the screw 4 passing through the screw holes 110, 120 and the oval hole 21 is exactly positioned onto the protruded posts 111, 121 such that the oval hole 21 provides fine adjustment of the leg plate facilitating tolerance space to load and unload the leg plate 2. Finally, the screw 4 at the screw hole 110, 120 is tighten and the two leg plates 2 are positioned.

There is a cavity 5 at the lower end of the rivet point of the two clipping plates 11, 12 and the two ends symmetrical to the cavity 5 are provided with a single side protruded block 50. The protruded block 50 is used to hold a compression spring 6 so as to provide extension when the handle 1 clips the clipping plates 11, 12 so as to restore to an open position.

Figure 3:
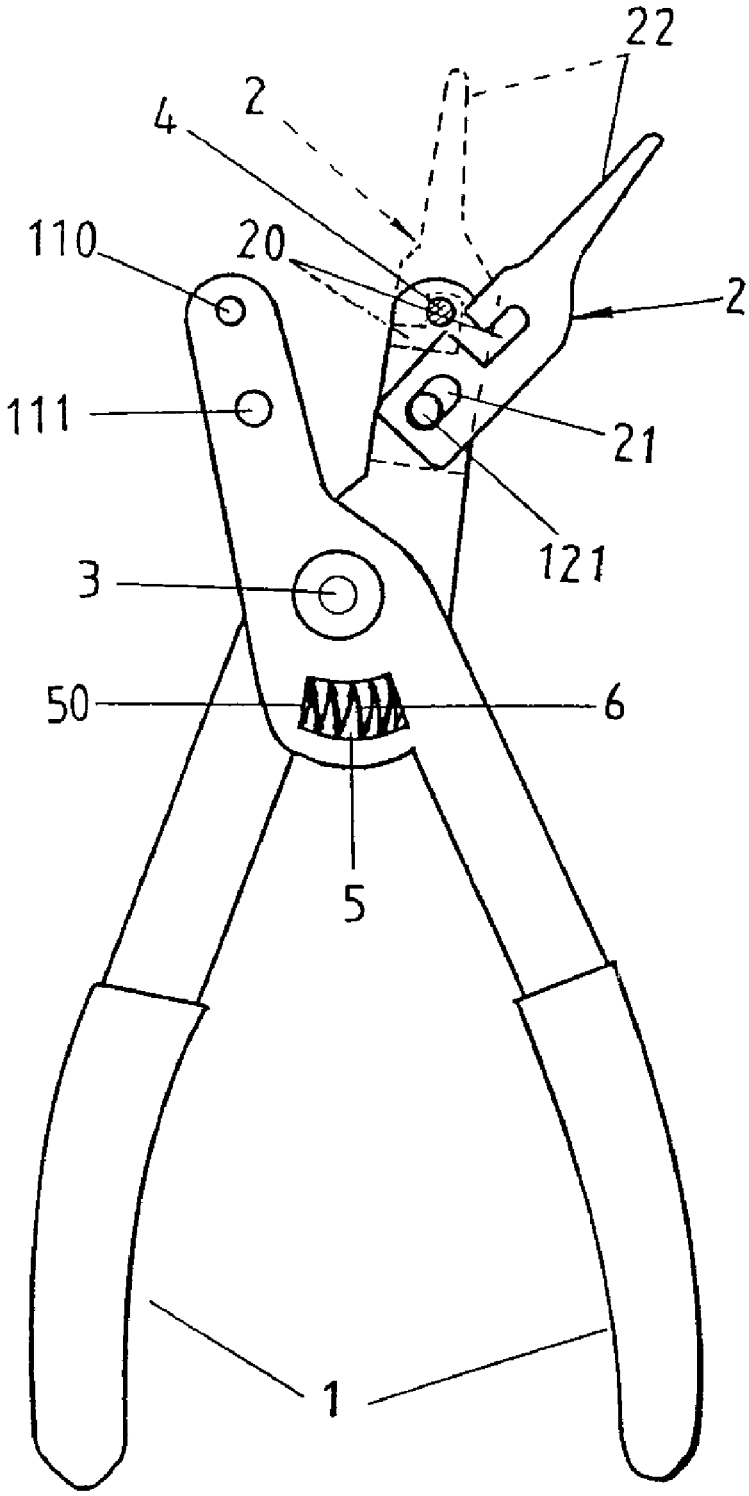
FIG. 3 is a schematic view showing the screw and the protruded post at the front end of the handle in accordance with the present invention.

As shown in FIG. 3, there is shown the action of protruded post with respect to the screw at the front end of the handle, wherein the L-shaped slot 20 and the oval hole 21 respectively engages with the screw holes 110, 120 and the protruded post 111, 121. In FIG. 3, the solid line indicates the leg plate before it is combined, and the dotted line indicates after it is combined. When the oval hole is fitted to the protruded post 111, 121, i.e., the oval hole 21 possesses a tolerance space to adjust, after that the L-shaped slot 20 is mounted to the screw 4, the oval hole 21 is slidable within the tolerance space. The screw 4 is used to lock the leg plate 2 to the front end of the clipping plates 11, 12.

The oval hole 21 allows the screw 4 to be lifted a short distance so that the leg plate 4 can be secured, and slight adjust the screw 4 to lock.

In the present invention, the L-shaped slot 20 and the oval hole 21 are fastened at the screw hole 110, 120 and the protruded post 111, 121, wherein the L-shaped slot 20 engagement is related to the force exertion direction of the loading and unloading of the C-shaped ring, which can effectively cause the leg plate 2 to be clipped on the handle 1 so that the force exerted by the leg plate 2 will not bias.

Figure 4:
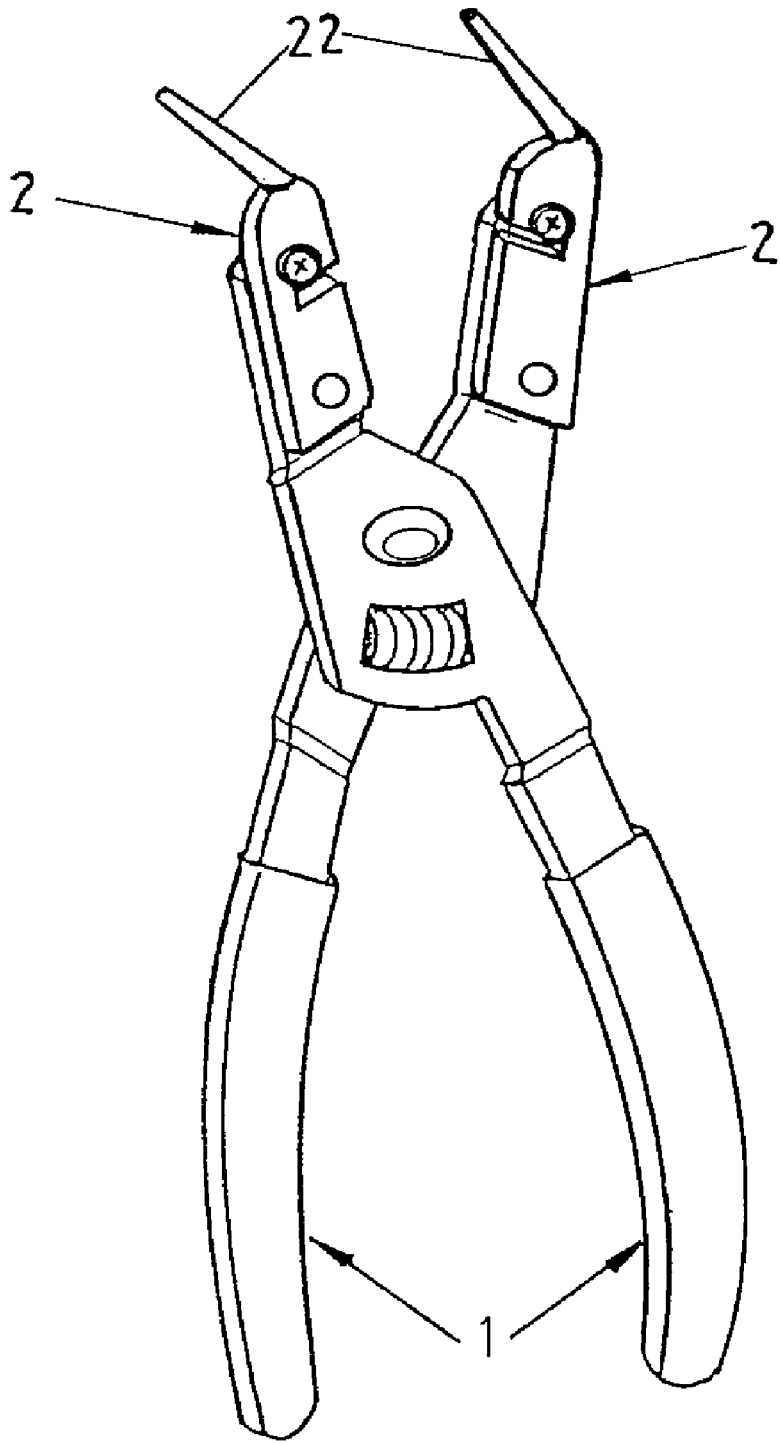
FIG. 4 is a schematic view showing the appropriate bending angle at the peg plate of the present invention.
Figure 5:
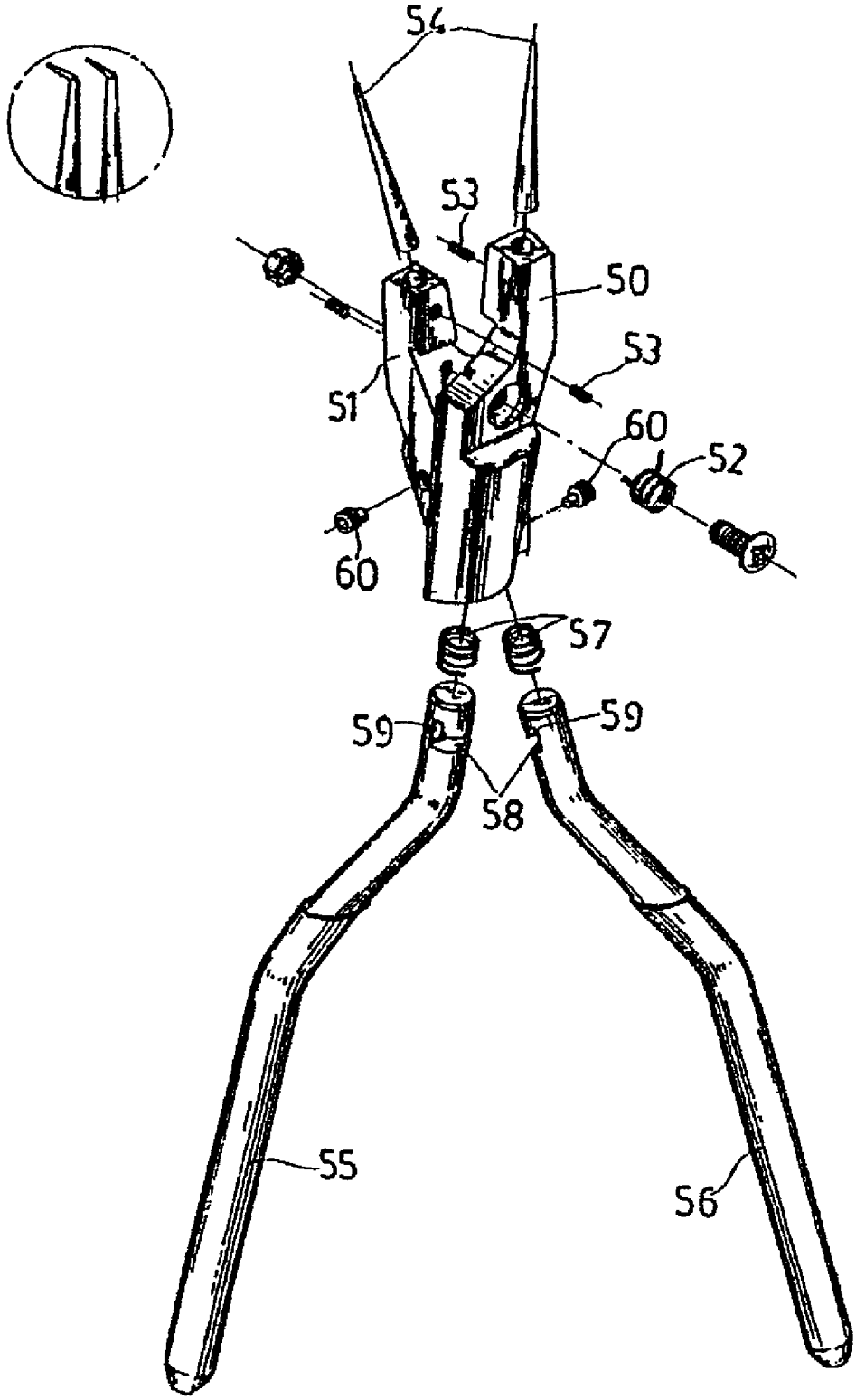
FIG. 5 PRIOR ART
FIG. 5 shows a conventional in Taiwan Publication No. 122049.
Figure 6:
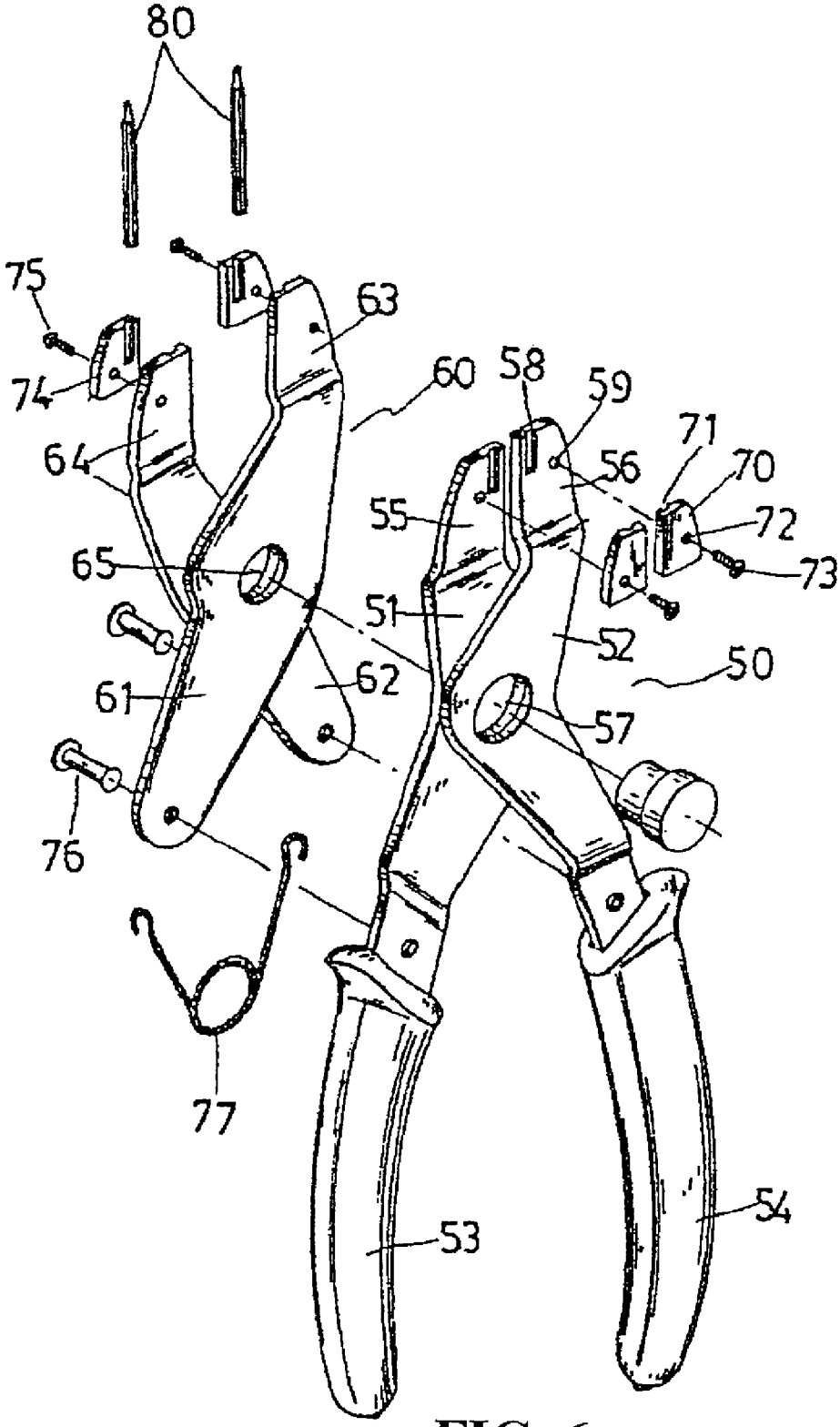
FIG. 6 PRIOR ART
FIG. 6 shows a conventional art in Taiwan Publication No. 223294.

When loading or unloading C ring fastener, due to the restriction of the size of the C-ring fastener and the space to carry out the action, the size and specification of the pointed leg 22 can be made into different size, or the pointed leg 22 can be bent to an appropriate angle, as shown in FIG. 4, this will allow the plier to be used in all environment.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A spring plier comprising a clipping handle and two symmetrical plier leg plates, and the clipping handle including two reverse direction similar shape plier plates mounted with rivets, the handle mounted with a cover, characterized in that the front end of the two clipping plier plate are respectively provided with a screw hole and a protruded post, the two plier leg plate corresponding to the screw hole and the protruded post are provided with a L-shaped fastening slot and an oval hole, and the front end is a pointed insertion leg, the L-shaped fastening slot engages at a screw fastened to the screw hole at the front end of the plier plate, and the oval hole is placed onto the protruded post, the oval hole provides fine adjustment of leg plate and provides a tolerance facilitating loading and unloading of leg plate, then the screw is tighten so as to secure and limit the two leg plates.

2. The spring plier of claim 1, wherein the fastening slot on the leg plate is of opened slot allowing appropriate fastening.

3. The spring plier of claim 1, wherein the front end pointed insertion leg of the leg plate is bent to an appropriate angle to provide unloading and loading of C-ring fastener.

* * * * *